US006119575A

United States Patent [19]

Dragone et al.

[11] Patent Number: 6,119,575

[45] Date of Patent: Sep. 19, 2000

[54] BODY ARMOR

[75] Inventors: Gaetor J. Dragone, Jacksonville; James Dale Taylor, Fernandina Beach, both of Fla.

[73] Assignee: American Body Armor, Jacksonville, Fla.

[21] Appl. No.: 09/024,951

[22] Filed: Feb. 17, 1998

[51] Int. Cl.[7] ..... F41H 5/04; F41H 5/08

[52] U.S. Cl. ..... 89/36.05; 89/36.02; 2/2.5

[58] Field of Search ..... 89/36.02, 36.05; 2/2.5; 428/911; 109/49.5

[56] References Cited

U.S. PATENT DOCUMENTS

| | | | |
|---|---|---|---|
| 4,574,105 | 3/1986 | Donovan | 428/911 |
| 4,820,568 | 4/1989 | Harpell et al. | 428/911 |
| 4,944,974 | 7/1990 | Zachariades | 428/36.1 |
| 4,989,266 | 2/1991 | Borgese et al. | 2/2.5 |
| 5,179,244 | 1/1993 | Zufle | 89/36.02 |
| 5,180,880 | 1/1993 | Zufle | 89/36.02 |
| 5,306,557 | 4/1994 | Madison | 428/304.4 |
| 5,316,820 | 5/1994 | Harpell et al. | 428/109 |
| 5,327,811 | 7/1994 | Price et al. | 89/36.05 |
| 5,362,527 | 11/1994 | Harpell et al. | 428/33 |
| 5,376,426 | 12/1994 | Harpell et al. | 428/109 |
| 5,440,965 | 8/1995 | Cordova et al. | 89/36.02 |
| 5,591,933 | 1/1997 | Li et al. | 89/36.02 |
| 5,619,748 | 4/1997 | Nelson et al. | 2/2.5 |
| 5,660,913 | 8/1997 | Coppage, Jr. | 428/102 |
| 5,724,670 | 3/1998 | Price | 2/2.5 |
| 5,796,028 | 8/1998 | Field et al. | 89/36.05 |
| 5,926,842 | 7/1999 | Price et al. | 2/2.5 |

FOREIGN PATENT DOCUMENTS

| | | | |
|---|---|---|---|
| 597165 | 5/1994 | European Pat. Off. | 89/36.05 |
| 94/23263 | 10/1994 | WIPO | 89/36.02 |

*Primary Examiner*—Stephen M. Johnson
*Attorney, Agent, or Firm*—Renner, Otto, Boisselle & Sklar

[57] ABSTRACT

In one embodiment, the present invention relates to a composite for body armor containing at least one ply comprising aromatic fibers in a first polymeric matrix, at least one ply of a woven plastic, and at least one ply comprising polyolefin fibers in a second polymeric matrix.

18 Claims, 1 Drawing Sheet

BODY ARMOR

TECHNICAL FIELD

The present invention relates generally to composites for body armor. In particular, the present invention relates to body armor composites containing at least three different layers.

BACKGROUND OF THE INVENTION

Ballistic articles including body armor such as bullet proof vests are known. Body armor including layers of fabric made from woven high strength plastic fibers is also known.

There are at least three desirable characteristics associated with body armor. First, body armor must prevent penetration by an incoming high energy projectile. Second, body armor must minimize the impact of an incoming high energy projectile. Minimizing impact is determined by evaluating the back face deformation which corresponds to trauma level experienced by a projectile that does not penetrate the body armor. This also refers to blunt trauma, which corresponds to the amount of energy transferred to a user of body armor upon impact of a high energy projectile. Finally, body armor must be comfortable enough in order to induce increased use. There are, in turn, three key factors which affect the comfortability of a given body armor; namely, weight, thickness and flexibility.

Ballistic vests are regularly certified by subjecting them to ballistics testing to measure there ability to protect against different projectiles fired from different types of weapons at various angles. One ballistic test commonly used in the industry is the National Institution of Justice (NIJ) Standard 0101.03. NIJ Standards establish minimum performance requirements and methods to test body armor for ballistic resistance. In particular, the Standard sets minimum levels of a number of characteristics including performance in connection with preventing penetration and minimizing back-face deformation.

In particular, ballistic tests are provided to address many different projectiles and energy levels. Three of these tests include NIJ Threat Level II, IIA and IIIA. Threat Level II relates to higher velocity 357 magnum (158 gr) and 9 mm (124 gr) bullets (impact velocities of less than about 1395 feet per second and 1175 feet per second, respectively). Threat Level IIA relates to lower velocity 357 magnum (158 gr) and 9 mm (124 gr) bullets (impact velocities of less than about 1250 feet per second and 1090 feet per second, respectively). Threat Level IIIA relates to 44 magnum (240 gr) and submachine gun 9 mm (124 gr) bullets (impact velocities of less than about 1400 feet per second).

Generally speaking, providing body armor which effectively prevents projectile penetration and minimizes back-face deformation is uncomfortable. Similarly, body armor which is comfortable has undesirably low levels of projectile penetration and backface deformation. Although ballistic performance appears inversely proportional to comfort, there is a need to provide body armor which possesses simultaneously the ability to prevent penetration of projectiles, minimize backface deformation and provide increased comfortability. In other words, there is a need for body armor of increasingly lighter weight, decreased thickness while preventing penetration by incoming projectiles and minimizing blunt trauma.

SUMMARY OF THE INVENTION

In one embodiment, the present invention relates to a composite for body armor containing at least one ply comprising aromatic fibers in a first polymeric matrix, at least one ply of a woven plastic, and at least one ply comprising polyolefin fibers in a second polymeric matrix.

In another embodiment, the present invention relates to a composite for body armor containing at least one ply comprising aramid fibers crossplied in a 0°/90°/0°/90° orientation in a first polymeric matrix, at least one ply comprising polyethylene fibers crossplied in a 0°/90° orientation in a second polymeric matrix, and at least one ply of a woven plastic positioned between at least one aramid fiber ply and at least one polyethylene fiber ply.

In yet another embodiment, the present invention relates to body armor comprising a composite containing from 1 to about 30 plies of a ply comprising polyamide fibers in a first polymeric matrix, from 1 to about 25 plies of a ply of a woven plastic, and from 1 to about 40 plies of a ply comprising polyolefin fibers in a second polymeric matrix.

As a result of the present invention, body armor is provided which effectively prevents penetration from an incoming projectile and minimizing back face deformation at levels exceeding NIJ Level II, IIA and IIIA Standards, while simultaneously providing a high level of comfortability. The high level of comfortability is attributable to the light weight, thinness and flexibility of the body armor of the present invention.

DESCRIPTION OF THE PREFERRED EMBODIMENTS

Figure 1:
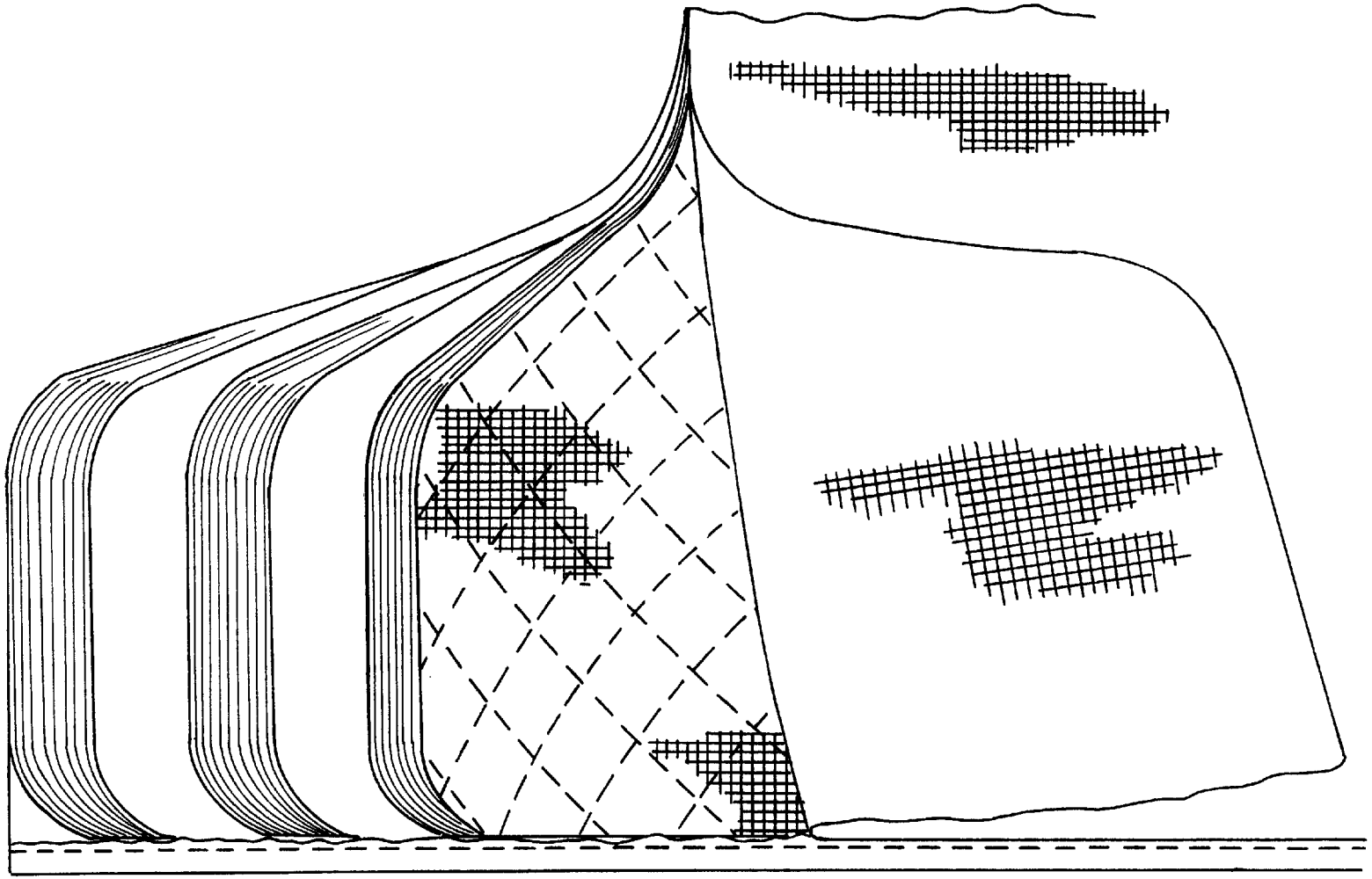
FIG. 1 illustrates a fragmentary view showing the three sections of a body armor vest according to the present invention.

The body armor of the present invention is made of a composite containing at least three sections. Each of the three sections contains at least one ply or layer. The three sections contain plies or layers of different materials compared to each other.

A first section contains at least one ply or layer made from aromatic fibers. A fiber is an elongated monofilament body of substantially uniform diameter having a long dimension substantially greater than the width or thickness of the body. In a preferred embodiment, the first section contains a ply or layer made of a network of aromatic fibers dispersed in a polymeric matrix, such as a prepreg tape. For ease and handling, the aromatic fiber impregnated resin matrix can be sandwiched between a thermoplastic film.

Fibers may be arranged in networks having various configurations which are embedded or substantially embedded in a polymeric matrix which preferably substantially coats each filament contained in the fiber network. The manner in which the fibers are dispersed or embedded in the polymeric matrix may vary widely. For example, a plurality can be grouped together to form a twisted or untwisted yarn bundle in various alignment. The fibers may be formed as a felt, knitted or woven into a network, fabricated into non-woven fabric, arranged in parallel array, layered array, or formed into a woven or non-woven fabric by any of a variety of conventional techniques and dispersed into the matrix employing any suitable technique as for example melt blending the fibers in a melt of the polymer matrix, solution blending the fibers in a solution of the polymer followed by removal of the solvent and consolidation of the polymer coated fibers, polymerization of the monomer in the presence of the fiber and the like. In a preferred embodiment, the fibers are formed into a non-woven fabric.

In a preferred embodiment, a plurality of uniaxially layers in which fibers are aligned substantially parallel and undirectionally such as in prepreg (polymeric matrix), protruded sheet and the like which are fabricated into a laminate fibrous layer containing a plurality of such uniaxial layers in which polymer forming the matrix coats or substantially coats the filaments of the multi-filament fibers and the coated fibers are arranged in a sheet like array and aligned parallel to another along a common fiber direction. Successive uniaxial layers of such coated, unidirectional fibers can be rotated with respect to the previous layer to form a laminated fibrous layer (laminated unidirectional tape). An example of such laminated fibrous layers are composites with 0°/90°/0°/90° layout of fibers in adjacent uniaxial layers. The laminated fibrous layer composed of the desired number of uniaxial layers can be molded at a suitable temperature and pressured to form a single layer having a desired thickness which can be bonded within a thermoplastic film.

The polymeric matrix is preferably a flexible polymeric film formed from a thermoplastic resin or an elastomeric resin. Thermoplastic resins include polylactones, polyurethanes, polycarbonates, polysulfones, polyether ether ketones, polyimides, polyamides, polyesters, poly (arylene oxides), poly(arylene sulfides) and polyetherimides. Elastomeric resins include polyurethane elastomers, fluoroelastomers and block copolymers of one or more of butadiene, acrylonitrile, polystyrenes, polyesters, low density polyolefins, vinyl polymers and copolymers and acrylic polymers and copolymers.

The denier of the fiber may vary widely. In general, fiber denier is equal to or less than about 4,000. In a preferred embodiment of the invention, the fiber denier is from about 10 to about 4,000, more preferably from about 10 to about 1,000, and most preferably from about 20 to about 400. The cross-section of the fibers may vary widely. Useful fibers may have a circular cross section, oblong cross section or irregular or regular multilobal cross sections having one or more regular or irregular lobes projecting from the linear or longitudinal axis of the fibers.

The aromatic fibers can be made of any aromatic plastic. Aromatic plastics include aromatic polyamides such as Kevlar®, Twaron® and Nomax®, aromatic unsaturated polyesters such as polyethylene terephthalate, aromatic polyimides, aromatic polyamideimides, aromatic polyesteramideimides, aromatic polyetheramideimides and aromatic polyesterimides. Aromatic polyamides include poly(metaphenylene isophthalamide) also known as Nomax®, poly(p-phenylene teraphthalamide) also known as Kevlar®, poly(1,4-benzamide), polychloro-1,4-phenylene terephthalamide, poly(1,4-phenylene fumaramide), poly(4,4'-benzanilide muconamide), poly(1,4-phenylene mesaconamide), poly(1,4-phenylene cyclohexyleneamide), polychloro-1,4-phenylene-2,5-pyridine amide, polychloro-1,4-phenylene-4,4'-stilbeneamide, poly(1,4-phenylene-4,4'-azobenzene amide), poly(3,8-phenanthridinone terephthal amide), poly(4,4'-biphenylene terephthal amide), poly(4,4'-biphenylene 4,4'-bibenzo amide), poly(1,4-phenylene 4,4'-bibenzo amide), poly(1,4-phenylene 4,4'-terephenylene amide), poly(1,4-phenylene 2,14-naphthal amide), poly(1,5-naphthylene terephthal amide), poly(3,3'-dimethyl-4,4-biphenylene terephthal amide), poly(3,3'-dimethoxy-4,4'-biphenylene terephthal amide), poly(3,3'-dimethoxy-4,4-biphenylene 4,4'-bibenzo amide) and the like; polyoxamides such as those derived from 2,2'dimethyl-4,4'diamino biphenyl and chloro-1,4-phenylene diamine. Aromatic polyesters include polyethylene naphthalate, polyethylene terephthalate, polyethylene isophthalate and polyethylene oxybenzoate. Copolymers of any of the above-mentioned materials can also be used, including copolymers with aliphatic polymers. In a preferable embodiment, aramid fibers are employed. An aramid is a substantially aromatic polyamide.

Methods of making the first section (network of aromatic fibers in a polymeric matrix) are generally described in U.S. Pat. Nos. 4,916,000; 4,748,064; 4,737,401; 4,681,792; 4,650,710; 4,623,574; 4,563,392; 4,543,286; 4,501,856; 4,457,985 and 4,403,012 which are hereby incorporated by reference.

Although there is no particular limit to the number of plies or layers used in the first section, in one embodiment, from 1 to about 30 plies containing aromatic fibers are used in the first section. In another embodiment, from about 2 to about 25 plies containing aromatic fibers are used in the first section. In a preferred embodiment, from about 3 to about 15 plies containing aromatic fibers are used in the first section.

In one embodiment, the thickness of one ply or layer of the first section is from about 0.001 to about 0.1 inches. In a preferred embodiment, the thickness of one ply or layer of the first section is from about 0.005 to about 0.05 inches. In a most preferred embodiment, the thickness of one ply or layer of the first section is from about 0.0075 to about 0.025 inches.

An example of a commercially available ply or layer made of aromatic fibers is Gold Flex™ available from Allied Signal.

A second section is a fabric construction of a woven plastic. The woven plastic layer has a denier between about 180 and about 1500. In a preferred embodiment the woven plastic fabric has denier between about 200 and about 1,000. In a more preferred embodiment the woven plastic fabric has denier between about 250 and about 750.

Plastics which may be used for the woven plastic fabric are varied and include any plastic which can be formed into strands and woven. Woven plastic fabrics include polyolefins such as polyethylene, polypropylene, copolymers of polyethylene and polypropylene, polybutylene and so on; polyamides such as nylons and aramids such as Kevlar®, Twaron® and Nomax® available from DuPont; and nylons, unsaturated and saturated polyesters; polycarbonates; acrylics; aromatics such as polybenzoxazole, polybenzothiazole, and p-phenylenebenzobisoxazole available from Toyobo; and others.

Particularly preferred fabrics are commercially available from a number of sources and include woven Kevlar® fabric having deniers of 200, 400, 840, 1000 and 1500; woven Twaron® fabric having deniers of 200, 400, 840, 1000 and 1500; and Spectra® 900 and Spectra® 1000 available from Allied Signal (woven polyethylene fabrics). Woven polyethylene fabrics have deniers of 180, 215, 375, 650 and 1200.

Although there is no particular limit to the number of plies or layers used in the second section, in one embodiment, from 1 to about 25 plies of woven plastic fabric are used in the second section. In another embodiment, from about 2 to about 20 plies of woven plastic fabric are used in the second section. In a preferred embodiment, from about 3 to about 10 plies of woven plastic fabric are used in the second section.

In one embodiment, the thickness of one ply or layer of the second section is from about 0.0001 to about 0.1 inches. In a preferred embodiment, the thickness of one ply or layer of the second section is from about 0.001 to about 0.05 inches. In a most preferred embodiment, the thickness of one ply or layer of the second section is from about 0.0025 to about 0.01 inches.

A third section contains at least one ply or layer made from polyolefin fibers. In a preferred embodiment, the third section contains a ply or layer made of a network of polyolefin fibers dispersed in a polymeric matrix, such as a prepreg tape. For ease and handling, the polyolefin fiber impregnated resin matrix can be sandwiched between a thermoplastic film.

Fibers may be arranged in networks having various configurations which are embedded or substantially embedded in a polymeric matrix which preferably substantially coats each filament contained in the fiber network. The manner in which the fibers are dispersed or embedded in the polymeric matrix may vary widely. For example, a plurality can be grouped together to form a twisted or untwisted yarn bundle in various alignment. The fibers may be formed as a felt, knitted or woven into a network, fabricated into non-woven fabric, arranged in parallel array, layered array, or formed into a woven or non-woven fabric by any of a variety of conventional techniques and dispersed into the matrix employing any suitable technique as for example melt blending the fibers in a melt of the polymer matrix, solution blending the fibers in a solution of the polymer followed by removal of the solvent and consolidation of the polymer coated fibers, polymerization of the monomer in the presence of the fiber and the like. In a preferred embodiment, the fibers are formed into a non-woven fabric.

In a preferred embodiment, a plurality of uniaxially layers in which fibers are aligned substantially parallel and undirectionally such as in prepreg (polymeric matrix), protruded sheet and the like which are fabricated into a laminate fibrous layer containing a plurality of such uniaxial layers in which polymer forming the matrix coats or substantially coats the filaments of the multi-filament fibers and the coated fibers are arranged in a sheet like array and aligned parallel to another along a common fiber direction. Successive uniaxial layers of such coated, unidirectional fibers can be rotated with respect to the previous layer to form a laminated fibrous layer (laminated unidirectional tape). An example of such laminated fibrous layers are composites with 0°/90° layout of fibers in adjacent uniaxial layers. The laminated fibrous layer composed of the desired number of uniaxial layers can be molded at a suitable temperature and pressured to form a single layer having a desired thickness which can be bonded within a thermoplastic film.

The polymeric matrix is preferably a flexible polymeric film formed from a thermoplastic resin or an elastomeric resin. The polymeric matrix of the third section is the same or different from the polymeric matrix of the first section. Accordingly, the same thermoplastic resins and elastomeric resins listed above are useful and thus not repeated here.

The denier of the fiber may vary widely. In general, fiber denier is equal to or less than about 4,000. In a preferred embodiment of the invention, the fiber denier is from about 10 to about 4,000, more preferably from about 10 to about 1,000, and most preferably from about 20 to about 400. The cross-section of the fibers may vary widely. Useful fibers may have a circular cross section, oblong cross section or irregular or regular multilobal cross sections having one or more regular or irregular lobes projecting from the linear or longitudinal axis of the fibers.

The polyolefin fibers can be made of any polyolefin. Polyolefins include polymer and copolymers of monoolefins having from 2 to about 20 carbon atoms and more preferably from 2 to about 12 carbon atoms per molecule. Monoolefins useful for making polyolefins preferably contain a terminal olefin bond and these include ethylene, propylene, 1-butene, 1-pentene, 4-methyl-1-pentene, 3-methyl-1-butene, 1-octene, 1-decene and 4-ethyl-1-hexene. Examples of such homopolymers include polyethylene (including low density, medium density, high density, linear low density and ultralow density polyethylene), polypropylene (including low density, high density and isotactic polypropylene), poly-1-butene, poly-3-methyl-1-butene and poly-4-methyl-1-pentene. The examples of copolymers within the above definition include copolymers of ethylene with from about 1% to about 99% by weight of propylene, copolymers of propylene with about 1% to about 99% by weight of ethylene or 1-butene, etc. Polymers prepared from blends of copolymers or blends of copolymers with homopolymers also are useful.

Preferred polyolefins include high molecular weight polyethylene, high molecular weight polypropylene and copolymers thereof. In one embodiment, high molecular weight polyethylene has a molecular weight of at least about 150,000, preferably at least about 1,000,000, and most preferably from about 2,000,000 to about 5,000,000 (extended chain polyethylene). In one embodiment, high molecular weight polypropylene has a molecular weight of at least about 200,000, preferably at least about 1,000,000, and most preferably at least about 2,000,000.

Methods of making the third section (network of polyolefin fibers in a polymeric matrix) are generally described in U.S. Pat. Nos. 4,916,000; 4,748,064; 4,737,401; 4,681,792; 4,650,710; 4,623,574; 4,563,392; 4,543,286; 4,501,856; 4,457,985 and 4,403,012 which are hereby incorporated by reference.

Although there is no particular limit to the number of plies or layers used in the third section, in one embodiment, from 1 to about 40 plies containing polyolefin fibers are used in the third section. In another embodiment, from about 2 to about 30 plies containing polyolefin fibers are used in the third section. In a preferred embodiment, from about 3 to about 20 plies containing polyolefin fibers are used in the third section.

In one embodiment, the thickness of one ply or layer of the third section is from about 0.0001 to about 0.05 inches. In a preferred embodiment, the thickness of one ply or layer of the third section is from about 0.001 to about 0.01 inches. In a most preferred embodiment, the thickness of one ply or layer of the third section is from about 0.0025 to about 0.0075 inches.

Examples of a commercially available ply or layer made of polyolefin fibers include Spectra Shield® Plus Flex, Spectra Shield® Plus LCR and Spectra Shield® LCR available from Allied Signal.

The three sections of the body armor of the present invention may be arranged in any orientation, so long as the body armor contains at least one ply or layer of each of the three layers. For example, describing a composite by listing the outer or impact section first and the inner section adjacent the wearer last, the body armor is arranged in any one of: at least one ply or layer of the first section, at least one ply or layer of the second section, and at least one ply or layer of the third section; at least one ply or layer of the first section, at least one ply or layer of the third section, and at least one ply or layer of the second section; at least one ply or layer of the second section, at least one ply or layer of the third section, and at least one ply or layer of the first section; at least one ply or layer of the second section, at least one ply or layer of the first section, and at least one ply or layer of the third section; at least one ply or layer of the third section, at least one ply or layer of the first section, and at least one ply or layer of the second section; and at least one ply or layer of the third section, at least one ply or layer of the second section, and at least one ply or layer of the first section. Most preferred orientations are at least one ply or layer of the first section, at least one ply or layer of the second section, and at least one ply or layer of the third section and at least one ply or layer of the third section, at least one ply or layer of the second section, and at least one ply or layer of the first section.

The body armor of the present invention possesses a high level of comfort, as measured by weight and thickness. In one embodiment, body armor made of a composite containing the three different sections described herein has a weight of less than about 16 oz/ft$^2$, and even less than about 14.5 oz/ft$^2$ while satisfying National Institution of Justice Standard 0101.03 Threat Level IIIA. In another embodiment, body armor made of a composite containing the three different sections described herein has a weight of less than about 12.5 oz/ft$^2$, and even less than about 11.5 oz/ft$^2$ while satisfying National Institution of Justice Standard 0101.03 Threat Level II. In yet another embodiment, body armor made of a composite containing the different three sections described herein has a weight of less than about 10.5 oz/ft$^2$, and even less than about 9.7 oz/ft$^2$ while satisfying National Institution of Justice Standard 0101.03 Threat Level IIA.

In one embodiment, body armor made of a composite containing the three different sections described herein has a thickness of less than about 0.19 inches, and even less than about 0.17 inches while satisfying National Institution of Justice Standard 0101.03 Threat Level II. In another embodiment, body armor made of a composite containing the three different sections described herein has a thickness of less than about 0.16 inches, and even less than about 0.14 inches while satisfying National Institution of Justice Standard 0101.03 Threat Level IIA. In yet another embodiment, body armor made of a composite containing the three different sections described herein has a thickness of less than about 0.24 inches, and even less than about 0.22 inches while satisfying National Institution of Justice Standard 0101.03 Threat Level IIIA. Thickness is directly related to flexibility. Accordingly, the exceptional thinness of the composites according to the present invention indicates that the composites possess exceptional flexibilty.

EXAMPLE 1

A composite containing 8 plies of an aramid fiber in a polymeric matrix, Gold Flex™ available from Allied Signal, 10 plies of polyethylene fibers in a polymeric matrix, Spectra Shield® Plus Flex available from Allied Signal, and 5 plies of a woven Kevlar® fabric having a denier of 400, is prepared to satisfy NIJ Standard 0101.03 Threat Level II. The Level II composite contains a total of 23 plies. The section containing aramid fiber plies is on the impact side of the composite while the section containing polyethylene fiber plies is on the wearer side with section containing the aramid woven fabric plies in between the two.

EXAMPLE 2

A composite containing 9 plies of an aramid fiber in a polymeric matrix, Gold Flex™ available from Allied Signal, 7 plies of polyethylene fibers in a polymeric matrix, Spectra Shield® Plus Flex available from Allied Signal, and 14 plies of a woven Kevlar® fabric having a denier of 400, is prepared to satisfy NIJ Standard 0101.03 Threat Level IIIA. The Level IIIA composite contains a total of 30 plies. The section containing aramid fiber plies is on the impact side of the composite while the section containing polyethylene fiber plies is on the wearer side with section containing the aramid woven fabric plies in between the two.

EXAMPLE 3

A composite containing 7 plies of an aramid fiber in a polymeric matrix, Gold Flex™ available from Allied Signal, 3 plies of polyethylene fibers in a polymeric matrix, Spectra Shield® Plus Flex available from Allied Signal, and 9 plies of a woven Kevlar® fabric having a denier of 400, is prepared to satisfy NIJ Standard 0101.03 Threat Level IIA. The Level IIA composite contains a total of 19 plies. The section containing aramid fiber plies is on the impact side of the composite while the section containing polyethylene fiber plies is on the wearer side with section containing the aramid woven fabric plies in between the two.

EXAMPLE 4

A composite containing 10 plies of an aramid fiber in a polymeric matrix, Gold Flex™ available from Allied Signal, 8 plies of polyethylene fibers in a polymeric matrix, Spectra Shield® Plus Flex available from Allied Signal, and 9 plies of a woven Twaron® fabric having a denier of 840, is prepared. The composite contains a total of 27 plies. The section containing polyethylene fiber plies is on the impact side of the composite while the section containing aramid fiber plies is on the wearer side with section containing the aramid woven fabric plies in between the two.

EXAMPLE 5

A composite containing 8 plies of an aramid fiber in a polymeric matrix, Gold Flex™ available from Allied Signal, 9 plies of polyethylene fibers in a polymeric matrix, Spectra Shield® Plus Flex available from Allied Signal, and 12 plies of a woven Twaron® fabric having a denier of 1000, is prepared. The composite contains a total of 29 plies. The section containing polyethylene fiber plies is on the impact side of the composite while the section containing aramid fiber plies is on the wearer side with section containing the aramid woven fabric plies in between the two.

EXAMPLE 6

A composite containing 6 plies of a polyethylene terephthalate fiber in a polymeric matrix, 5 plies of polyethylene fibers in a polymeric matrix, Spectra Shield® Plus LCR available from Allied Signal, and 9 plies of a woven polyethylene Spectra® 1000 available from Allied Signal, is prepared. The composite contains a total of 20 plies. The section containing polyethylene fiber plies is on the impact side of the composite while the section containing the polyolefin woven fabric plies is on the wearer side with section containing the aromatic unsaturated polyester fiber plies in between the two.

EXAMPLE 7

A composite containing 10 plies of an aramid fiber (Twaraon®) in a polymeric matrix, 7 plies of polyethylene fibers in a polymeric matrix, Spectra Shield® LCR available from Allied Signal, and 12 plies of a woven polyethylene fabric having a denier of 375, is prepared. The composite contains a total of 29 plies. The section containing aramid fiber plies is on the impact side of the composite while the section containing polyethylene fabric having a denier of 375 plies is on the wearer side with section containing the polyolefin fiber plies in between the two.

EXAMPLE 8

A composite containing 6 plies of an aramid fiber in a polymeric matrix, Gold Flex™ available from Allied Signal, 6 plies of polypropylene fibers in a polymeric matrix and 8 plies of a woven polyethylene fabric having a denier of 650, is prepared. The composite contains a total of 20 plies. The section containing polyolefin woven fabric plies is on the impact side of the composite while the section containing polypropylene fiber plies is on the wearer side with section containing the aramid fiber plies in between the two.

EXAMPLE 9

A composite containing 6 plies of an aramid fiber in a polymeric matrix, Gold Flex™ available from Allied Signal, 11 plies of polyethylene fibers in a polymeric matrix, Spectra Shield® Plus LCR available from Allied Signal, and 8 plies of a woven p-phenylenebenzobisoxazole fabric available from Toyobo, is prepared. The composite contains a total of 25 plies. The section containing the woven p-phenylenebenzobisoxazole fabric plies is on the impact side of the composite while the section containing aramid fiber plies is on the wearer side with section containing the polyethylene fiber plies in between the two.

Comparative Example 1

Three composites containing multiple plies of a woven Kevlar® fabric having a denier of 400, are prepared to satisfy NIJ Standard 0101.03 Threat Levels II, IIA and IIIA, respectively. The Level II composite contains 20 plies, the Level IIA composite contains 17 plies, and the Level IIIA composite contains 25 plies.

Comparative Example 2

Three composites containing multiple plies of woven Twaron® fabrics having deniers of 1000 and 1500, are prepared to satisfy NIJ Standard 0101.03 Threat Levels II, IIA and IIIA, respectively. The Level II composite contains 21 plies (14 plies of 1000 denier fabric and 7 plies of 1500 denier fabric), the Level IIA composite contains 17 plies (11 plies of 1000 denier fabric and 6 plies of 1500 denier fabric), and the Level IIIA composite contains 26 plies (17 plies of 1000 denier fabric and 9 plies of 1500 denier fabric).

Comparative Example 3

Three composites containing an equal amount of plies of an aramid fiber in a polymeric matrix, Gold Flex™ available from Allied Signal, and polyethylene fibers in a polymeric matrix, Spectra Shield® Plus Flex available from Allied Signal, are prepared to satisfy NIJ Standard 0101.03 Threat Levels II, IIA and IIIA, respectively. The Level II composite contains 22 plies, the Level IIA composite contains 18 plies, and the Level IIIA composite contains 28 plies. The section containing aramid fiber plies is on the impact side of the composite while the section containing polyethylene fiber plies is on the wearer side.

Comparative Example 4

A composite containing multiple plies of an aramid fiber in a polymeric matrix, Gold Flex™ available from Allied Signal, is prepared so that the relative weight per unit are is equal to 11.5 oz/ft$^2$. The composite contains 15 plies.

Comparative Example 5

A composite containing multiple plies of a woven Kevlar® fabric having a denier of 400, is prepared so that the relative weight per unit are is equal to 11.5 oz/ft$^2$. The composite contains 30 plies.

Comparative Example 6

A composite containing multiple plies of a polyethylene fibers in a polymeric matrix, Spectra Shield® Plus Flex available from Allied Signal, is prepared so that the relative weight per unit are is equal to 11.5 oz/ft$^2$. The composite contains 32 plies.

Objective measurement of comfortability is determined by considering the relative weight and thickness of a body armor composite. Table 1 describes comfortability values for a number of body armor composites possessing substantially same level of projectile penetration resistance and backface deformation resistance.

TABLE 1

COMFORTABILITY

| Model | NIJ Level | Weight (oz./sq.ft.) | Thickness (inches) |
|---|---|---|---|
| Com Ex 1 | II | 17.5 | 0.29 |
| Com Ex 2 | II | 16.8 | 0.24 |
| Com Ex 3 | II | 13.9 | 0.2 |
| Example 1 | II | 11.5 | 0.163 |

V 50 values are a quantitative measure of ballistic performance. The greater the V 50 value, the better the ballistic performance. Table 2 shows that, at the same level of comfort (measured by weight), composites according to the present invention exhibit better ballistic performance than each individual component section thereof.

TABLE 2

PERFORMANCE COMPARISON

| Material | Construction Type | Weight (oz./sq.ft.) | 9 mm V 50 | 357 Mag V 50 |
|---|---|---|---|---|
| Example 1 | Hybrid | 11.5 | 1697 | 1584 |
| Comparative Example 4 | Individual | 11.5 | 1660 | 1569 |
| Comparative Example 5 | Individual | 11.5 | 1584 | 1511 |
| Comparative Example 6 | Individual | 11.5 | 1633 | 1506 |

Blunt trauma as measured by back face deformation corresponds to the amount of energy transferred to a user of body armor upon impact of a high energy projectile. A smaller value of trauma corresponds to a lower amount of energy transferred to a user of body armor containing the given composite. Table 3 indicates that the composites according to the present invention exhibit better back face deformation (far exceeding Level II standards) and increased comfort (as measured by weight) at NIJ Standard 0101.03 Threat Level II.

TABLE 3

BLUNT TRAUMA COMPARISON

| Series | NIJ Level | Weight (oz./sq.ft.) | Trauma 44 Mag | Trauma 357 Mag | Trauma 9 mm | Trauma Average |
|---|---|---|---|---|---|---|
| Com Ex 1 | IIIA | 22 | 42 mm | | 33 mm | 38 mm |
| Com Ex 2 | IIIA | 20.6 | 40 mm | | 30 mm | 35 mm |
| Com Ex 3 | IIIA | 17.6 | 40 mm | | 27 mm | 34 mm |
| Example 2 | IIIA | 14.5 | 33 mm | | 25 mm | 29 mm |
| Com Ex 1 | II | 17.5 | | 38 mm | 33 mm | 36 mm |
| Com Ex 2 | II | 16.8 | | 38 mm | 30 mm | 34 mm |
| Com Ex 3 | II | 13.9 | | 34 mm | 27 mm | 31 mm |
| Example 1 | II | 11.5 | | 34 mm | 24 mm | 29 mm |
| Com Ex 1 | IIA | 14.4 | | 41 mm | 33 mm | 37 mm |
| Com Ex 2 | IIA | 13.6 | | 35 mm | 30 mm | 33 mm |
| Com Ex 3 | IIA | 11.3 | | 35 mm | 27 mm | 31 mm |
| Example 3 | IIA | 9.7 | | 33 mm | 24 mm | 29 mm |

The body armor of the present invention may be used in the fabrication of vests, pants, raincoats, gloves, boots, aprons, helmets, and the like. The body armor of the present invention is particularly suited for vests. In this connection, body armor composites containing at least the three sections described herein can be inserted or sewn into a vest having a pocket or containment means therein. The orientation of the three sections of a vest are illustrated in FIG. 1.

While the invention has been explained in relation to its preferred embodiments, it is to be understood that various modifications thereof will become apparent to those skilled in the art upon reading the specification. Therefore, it is to be understood that the invention disclosed herein is intended to cover such modifications as fall within the scope of the appended claims.

What is claimed is:

1. A composite for body armor comprising:

at least one ply comprising non-woven aromatic fibers in a first polymeric matrix;

at least one ply of a woven plastic, said woven plastic having a denier between about 180 and 1500; and at least one ply comprising non-woven polyolefin fibers in a second polymeric matrix.

2. The composite according to claim 1, wherein the woven plastic consists of at least one of a polyethylene, polypropylene, copolymers of polyethylene and polypropylene, polybutylene, nylon, aramid, unsaturated polyester, polycarbonate, acrylics, and p-phenylenebenzobisoxazole.

3. The composite according to claim 1 having an aerial density of less than about 14.5 oz/ft$^2$.

4. The composite according to claim 1 having an aerial density of less than about 11.5 oz/ft$^2$.

5. The composite according to claim 1 having an aerial density of less than about 9.7 oz/ft$^2$.

6. The composite according to claim 1, wherein the aromatic fibers in the first polymeric matrix are non-woven, unidirectional and crossplied in a 0°/90°/0°/90° orientation.

7. The composite according to claim 1, wherein the polyolefin fibers in the second polymeric matrix are non-woven, unidirectional and crossplied in a 0°/90° orientation.

8. A composite for body armor comprising:

at least one ply comprising non-woven aramid fibers crossplied in a 0°/90°/0°/90° orientation in a first polymeric matrix;

at least one ply comprising non-woven polyethylene fibers crossplied in a 0°/90° orientation in a second polymeric matrix; and at least one ply of a woven plastic positioned between said at least one aramid fiber ply and said at least one polyethylene fiber ply.

9. The composite according to claim 8 having a thickness of less than about 0.17 inches.

10. The composite according to claim 8, wherein the first polymeric matrix and the second polymeric matrix each consists of at least one of polylactones, polyurethanes, polycarbonates, polysulfones, polyether ether ketones, polyimides, polyamides, polyesters, polyarylene oxides, polyarylene sulfides, polyetherimides, polyurethane elastomers, fluoroelastomers and block copolymers of one or more of butadiene, acrylonitrile, polystyrenes, polyesters, polyolefins, vinyl polymers and copolymers and acrylic polymers and copolymers.

11. The composite according to claim 8, wherein the woven plastic consists of at least one of polyethylene, polyamide and p-phenylenebenzobisoxazole.

12. The composite according to claim 8, wherein the aramid fibers comprise poly(p-phenylene terephthalamide.

13. The composite according to claim 8 comprising:

from 2 to about 25 plies of the aramid fiber ply;

from 2 to about 20 plies of the woven plastic; and from 2 to about 30 plies of the polyethylene fiber ply.

14. Body armor comprising a composite comprising:

from 1 to about 30 piles of a ply comprising polyamide fibers in a first polymeric matrix;

from 1 to about 25 piles of a ply of a woven plastic wherein the woven plastic comprises at least one of polyethylene, polyamide and p-phenylenebenzobisoxazole and has a denier between about 180 and about 1500; and from 1 to about 40 piles of a ply comprising polyolefin fibers in a second polymeric matrix.

15. The body armor according to claim 14, wherein the body armor is a vest.

16. The composite according to claim 14, wherein the polyamide fiber comprise poly(p-phenylene terephthalamide.

17. The composite according to claim 14, wherein the polyolefin fibers comprise polyethylene.

18. A composite for body armor comprising:

at least one ply comprising non-woven aromatic fibers in a first polymeric matrix;

at least one ply of a woven plastic; and at least one ply comprising non-woven polyolefin fibers in a second polymeric matrix; the composite having an aerial density of less than about 14.5 oz/ft$^2$.

* * * * *